US007841736B2

(12) United States Patent
Chabria

(10) Patent No.: US 7,841,736 B2
(45) Date of Patent: Nov. 30, 2010

(54) FLASHLIGHT

(76) Inventor: Paul R. Chabria, 33W533 Marebarn LN, Wayne, IL (US) 60184

( * ) Notice: Subject to any disclaimer, the term of this patent is extended or adjusted under 35 U.S.C. 154(b) by 155 days.

(21) Appl. No.: 12/395,030

(22) Filed: Feb. 27, 2009

(65) Prior Publication Data

US 2010/0220465 A1 Sep. 2, 2010

(51) Int. Cl.
*F21L 4/04* (2006.01)

(52) U.S. Cl. ..... 362/201; 362/189; 362/205

(58) Field of Classification Search ..... 362/189, 362/196, 200, 201, 205
See application file for complete search history.

(56) References Cited

U.S. PATENT DOCUMENTS 4,419,718 A 12/1983 Chabria
4,628,418 A 12/1986 Chabria
4,644,451 A 2/1987 Chabria
4,819,140 A * 4/1989 Griffin ..... 362/189
D311,067 S 10/1990 Chabria
5,124,898 A 6/1992 Chabria
5,289,917 A 3/1994 Chabria
D355,272 S 2/1995 Chabria
D361,633 S 8/1995 Chabria
5,660,458 A 8/1997 Chabria
5,730,539 A 3/1998 Chabria
6,039,456 A 3/2000 Chabria

* cited by examiner

*Primary Examiner*—Stepehn F Husar
(74) *Attorney, Agent, or Firm*—John P. McGonagle

(57) ABSTRACT

A squeeze-activated flashlight including a holder configured to receive a lamp and one or more batteries, and a housing configured to receive the holder. The housing includes a resiliently flexible actuator member for activating the lamp.

20 Claims, 5 Drawing Sheets

FLASHLIGHT

BACKGROUND

The present invention is directed to a squeeze-activated flashlight, and in particular to a squeeze-activated flashlight having a holder configured to receive a lamp and one or more batteries, and a housing configured to receive the holder, the housing including a resiliently flexible actuator formed as a portion of a side wall of the housing and configured to be manually pressed inwardly to illuminate the lamp.

SUMMARY OF THE INVENTION

A squeeze-activated flashlight comprising a holder, a lamp coupled to the holder, one or more batteries located in the holder, and a housing configured to receive the holder. The holder includes a first end, a second end, an end wall and a sleeve. The end wall includes an aperture. The sleeve extends between a first end and a second end and includes a bottom wall, a top wall spaced apart from the bottom wall and a chamber located between the bottom wall and the top wall. The first end of the sleeve is coupled to the end wall. The second end of the sleeve includes an opening in communication with the chamber. The top wall includes a slot in communication with the chamber.

The lamp includes a bulb, a first terminal coupled to the bulb, and a second terminal coupled to the bulb. The first terminal comprises an elongate first conductor member. The second terminal comprises an elongate resiliently flexible second conductor member. The second conductor member is spaced apart from the first conductor member. The bulb is located in the aperture of the end wall of the holder. The first conductor member is located adjacent an interior surface of the bottom wall of the sleeve. The second conductor member extends from the chamber of the sleeve into the slot in the top wall of the sleeve.

One or more batteries are located in the chamber of the holder. The one or more batteries having a first end located adjacent the interior surface of the bottom wall of the sleeve. The first end of the one or more batteries includes a first terminal. The first conductor member of the lamp is in electrical contact with the first terminal of the one or more batteries. The one or more batteries includes a second end adjacent an interior surface of the top wall of the sleeve. The second end of the one or more batteries includes a second terminal. The second conductor member of the lamp is normally spaced outwardly from the second terminal of the one or more batteries in an opened condition such that the second conductor member of the lamp is not in electrical contact with the second terminal of the one or more batteries.

The housing includes a first end and a second end and a peripheral side wall extending between the first end and second end of the housing. The side wall forms a chamber and an opening at the first end of the housing in communication with the chamber of the housing. The side wall includes a resiliently flexible actuator member. The sleeve of the holder extends into the chamber of the housing through the opening in the first end of the housing such that the second conductor member of the lamp is associated with the actuator member of the housing. The actuator member is selectively inwardly bendable by manually pressing the actuator member, such that the actuator member resiliently bends the second conductor member of the lamp to a closed condition wherein the second conductor member is in electrical contact with the second terminal of the one or more batteries to illuminate the lamp.

BRIEF DESCRIPTION OF THE DRAWING FIGURES

DETAILED DESCRIPTION

Figure 1:
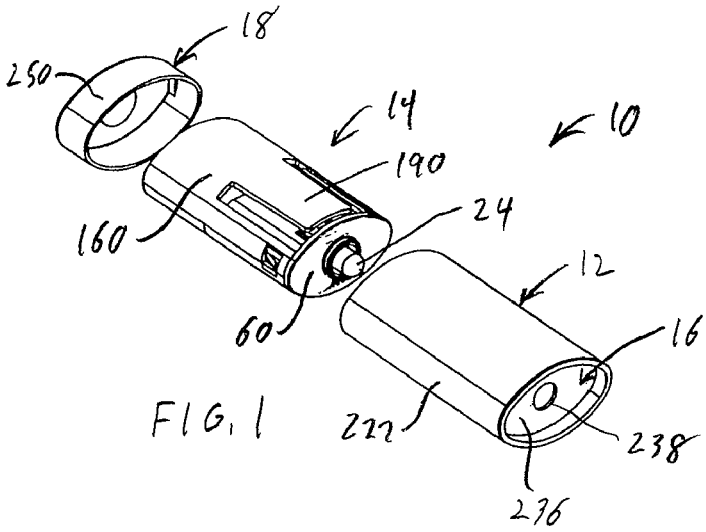
FIG. 1 is an exploded perspective view of a squeeze-activated flashlight as disclosed herein.
Figure 2:
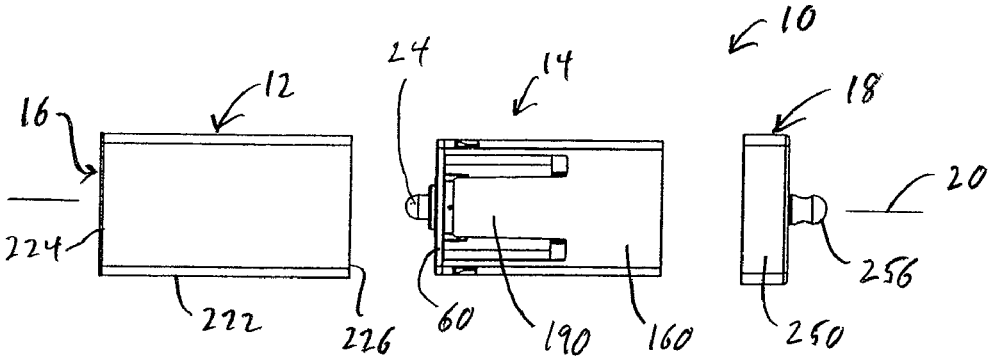
FIG. 2 is an exploded top view of the flashlight of FIG. 1.
Figure 3:
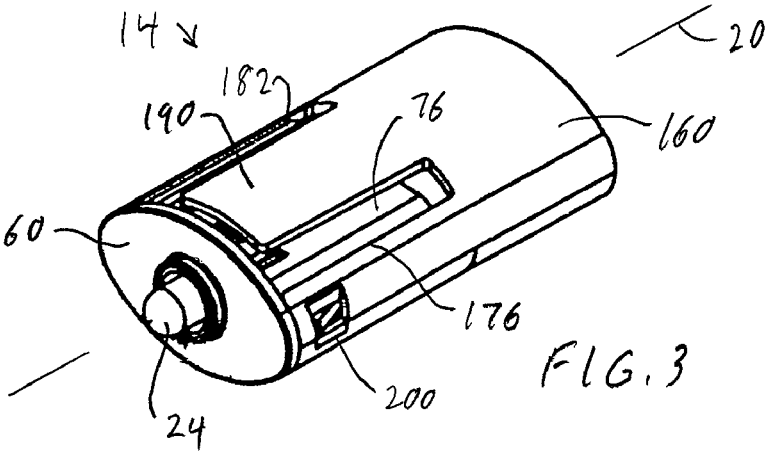
FIG. 3 is a perspective view of the cartridge of the flashlight.
Figure 5:
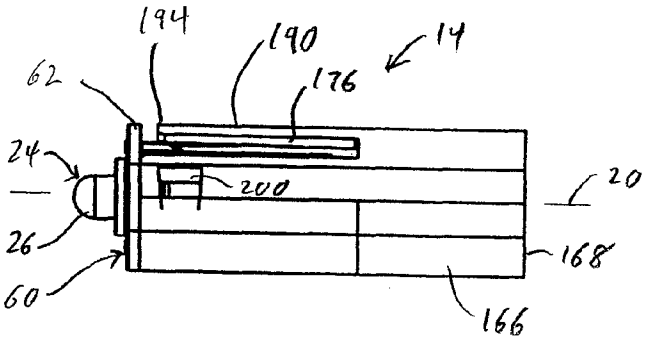
FIG. 5 is a side elevational view of the cartridge.
Figure 4:
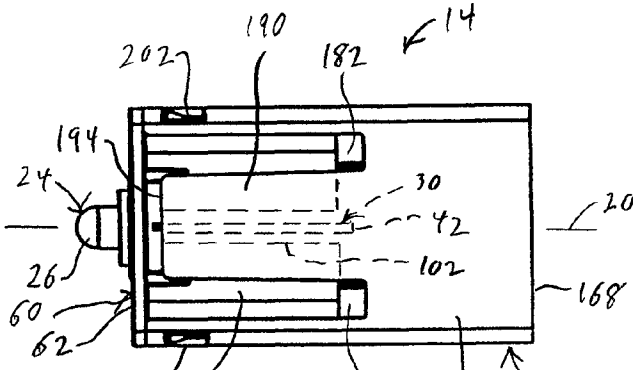
FIG. 4 is a top plan view of the cartridge.

A squeeze-activated flashlight 10 is shown in FIGS. 1 and 2. Flashlight 10 includes an outer resiliently flexible jacket 12, a cartridge 14 configured to be located within jacket 12, a front end cap 16 and a rear end cap 18 configured to be coupled to opposing ends of jacket 12. Flashlight 10 includes a central linear longitudinal axis 20. Flashlight 10 has a generally elliptical-shaped cross section including a major axis 21 and a minor axis 22 that is perpendicular to major axis 21. Major and minor axes 21 and 22 are both generally perpendicular to longitudinal axis 20.

Figure 6:
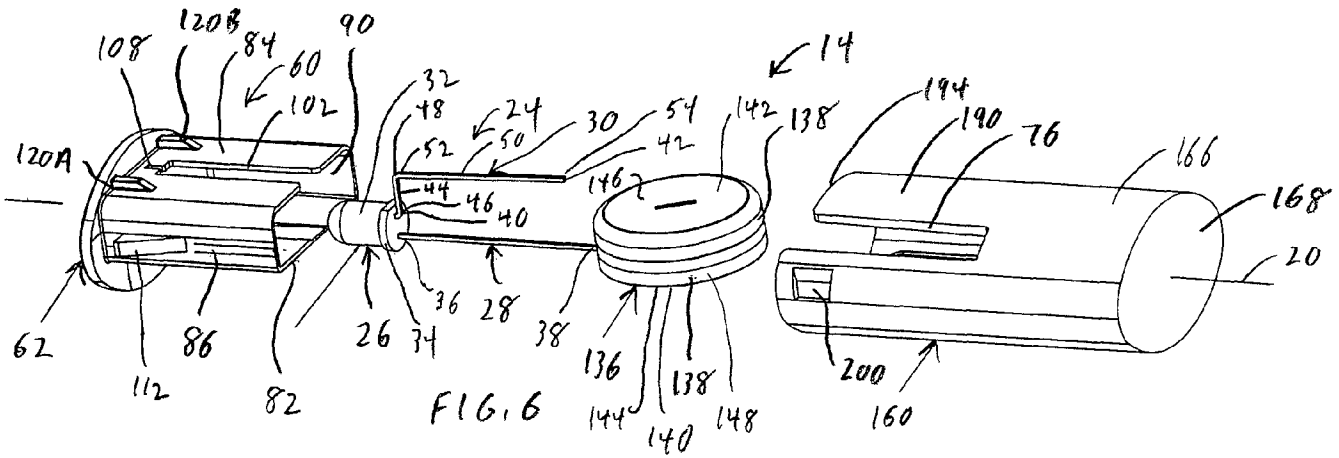
FIG. 6 is an exploded view of the cartridge showing the holder, lamp, batteries and housing of the cartridge.
Figure 7:
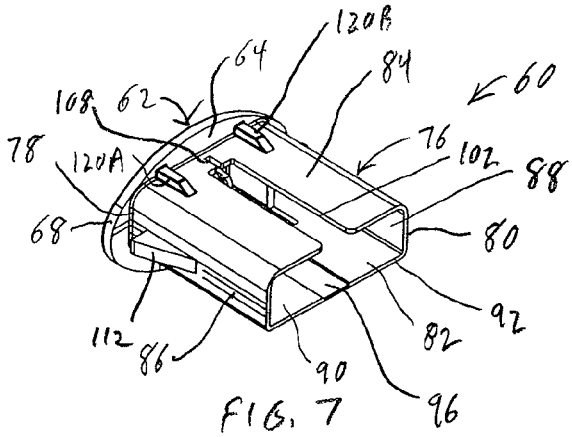
FIG. 7 is a perspective view of the holder.

As shown in FIG. 6, cartridge 14 includes an illuminating lamp 24. Illuminating lamp 24 includes an illuminating bulb 26, a first conductor member 28 comprising a first terminal electrically coupled to bulb 26 and a second conductor member 30 comprising a second terminal electrically coupled to illuminating bulb 26. Bulb 26 may comprise a light emitting diode (LED). Bulb 26 includes a generally cylindrical side wall 32 extending outwardly from a generally circular base 34. Base 34 projects radially outwardly from side wall 32. First conductor member 28 includes a first end 36 and a second end 38. First conductor member 28 extends generally linearly between first end 36 and second end 38. First end 36 is electrically coupled to bulb 26 and is coupled to a bottom surface of base 34. First conductor member 28 extends generally parallel to central longitudinal axis 20 of flashlight 10. First conductor member 28 may comprise a bare or uncovered generally cylindrical metal wire.

Second conductor member 30 extends between a first end 40 that is electrically coupled to bulb 26 and a second end 42. Second conductor member 30 includes a first portion 44 that extends generally linearly between a first end 46 and a second end 48. First end 46 of first portion 44 is electrically coupled to bulb 26 and is coupled to a bottom surface of base 34 of bulb 26. First portion 44 extends generally radially outwardly from base 34 of bulb 26 and with respect to axis 20. Second conductor member 30 also includes a second portion 50 having a first end 52 and a second end 54. First end 52 of second portion 50 is coupled to second end 48 of first portion 44. Second portion 50 extends generally linearly from first end 52 to second end 54. Second portion 50 of second conductor member 30 may extend generally parallel to first conductor member 28 and axis 20. Alternatively, second conductor member 30 may be angled outwardly with respect to first conductor member 28 and axis 20 as second portion 50 extends from first end 52 to second end 54. First conductor member 28 and second conductor member 30 extend outwardly from base 34 of bulb 26 in a generally cantilevered manner. Second conductor member 30 is resiliently flexible and bendable. Second conductor member 30 may comprise a bare or uncovered generally cylindrical metal wire. First conductor member 28 and second conductor member 30, including first portion 44 and second portion 50, are generally located in the same plane with respect to one another. Second conductor member 30 is resiliently flexible and bendable inwardly toward first conductor member 28.

Cartridge 14 also includes a holder 60. Holder 60 as shown in FIGS. 7-10 includes a generally planar elliptical-shaped end wall 62 having a generally planar interior surface 64 and a spaced apart and generally parallel generally planar outer surface 66. End wall 62 also includes a generally elliptical-shaped peripheral edge 68 and a generally circular central aperture 70 generally concentrically aligned with axis 20 and extending through end wall 62 from inner surface 64 to outer surface 66. A generally annular collar 72 extends outwardly from outer surface 66 of end wall 62 in a direction parallel to axis 20. Collar 72 is generally concentrically located about axis 20. Aperture 70 extends through collar 72.

Figure 10:
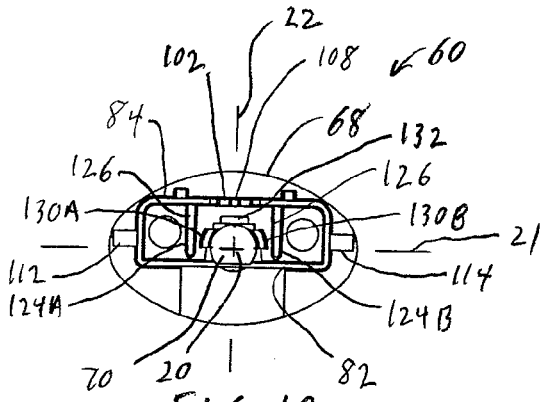
FIG. 10 is a rear elevational view of the holder.
Figure 11:
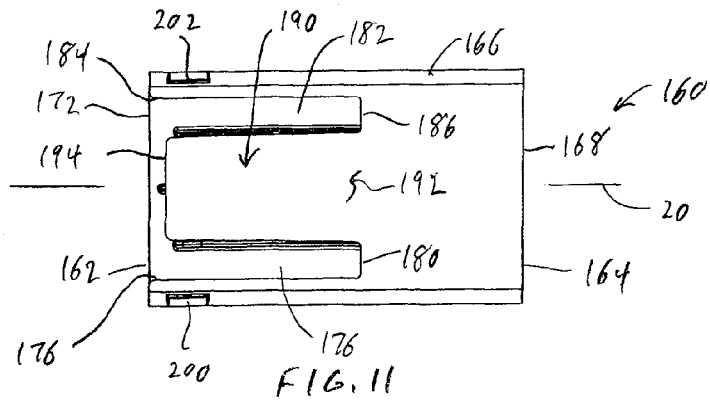
FIG. 11 is a top plan view of the housing.
Figure 12:
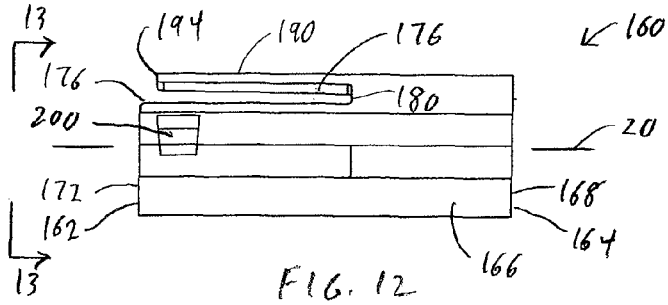
FIG. 12 is a side elevational view of the housing.
Figure 13:
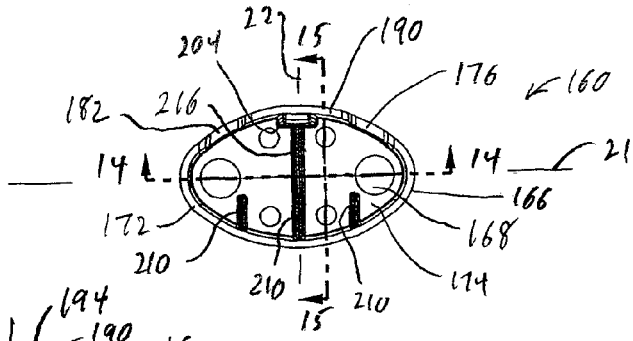
FIG. 13 is a front end view of the housing taken along line 13-13 of FIG. 12.
Figure 14:
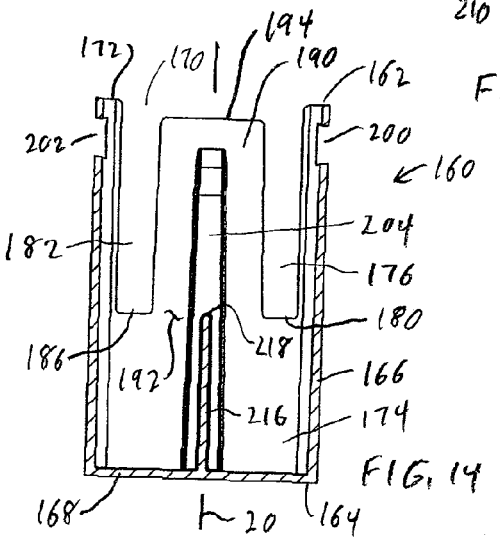
FIG. 14 is a cross sectional view of the housing taken along line 14-14 of FIG. 13.
Figure 15:
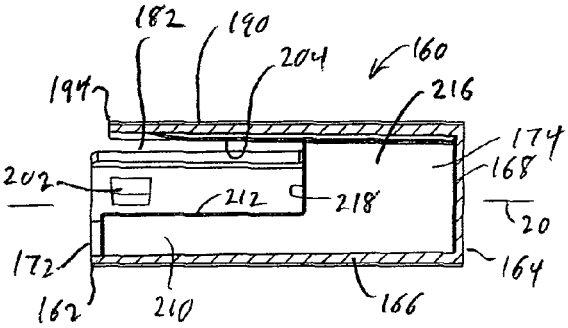
FIG. 15 is a cross sectional view of the housing taken along line 15-15 of FIG. 13.

Holder 60 also includes a sleeve 76 having a first end 78 and a second end 80. First end 78 of sleeve 76 is coupled to inner surface 64 of end wall 62. Sleeve 76 extends along axis 20 from first end 78 to second end 80. Sleeve 76 includes a generally planar and generally rectangular bottom wall 82, a generally planar and generally rectangular top wall 84 spaced apart from and generally parallel to bottom wall 82, a generally planar and generally rectangular first side wall 86 extending generally perpendicularly between bottom wall 82 and top wall 84, and a generally planar and generally rectangular second side wall 88 extending generally perpendicularly between bottom wall 82 and top wall 84 and being spaced apart from and generally parallel to first side wall 86. Bottom wall 82, top wall 84, first side wall 86 and second side wall 88 each extend from first end 78 to second end 80 of sleeve 76 and form a hollow chamber 90 in sleeve 76. Sleeve 76 has a generally rectangular cross section as shown in FIG. 10.

Sleeve 76 includes a generally rectangular opening 92 at second end 80 formed between bottom wall 82, top wall 84, first side wall 86 and second side wall 88. Opening 92 is in communication with chamber 90. Bottom wall 82 includes a generally rectangular aperture 94 located adjacent end wall 62. The interior surface of bottom wall 82 includes a groove 96 that extends generally parallel to axis 20 from aperture 94 to an outer end of bottom wall 82 at second end 80 of sleeve 76. Top wall 84 extends between a first end 98 located adjacent inner surface 64 of end wall 62 and a second end 100 located at second end 80 of sleeve 76. A generally linear and elongate slot 102 is located in top wall 84. Slot 102 extends from a closed first end 104 generally parallel to axis 20 to an open second end 106 located at second end 80 of sleeve 76. Slot 102 is in communication with chamber 90 and open second end 106 of slot 102 is in communication with opening 92. Slot 102 is located in top wall 84 generally midway between first side wall 86 and second side wall 88. Slot 102 includes spaced apart and generally parallel linear edges that extend from first end 104 to second end 106. Slot 102 includes a generally centrally located notch 108 at first end 104 that extends generally parallel to axis 20 toward inner surface 64 of end wall 62. Notch 108 is in communication with chamber 90. Second end 106 of slot 102 and notch 108 are spaced apart from inner surface 64 of end wall 62. Notch 108 is substantially narrower between generally parallel side edges that form notch 108 than is the remainder of slot 102 and is configured to closely receive first portion 44 of the second conductor member 30.

Figure 8:
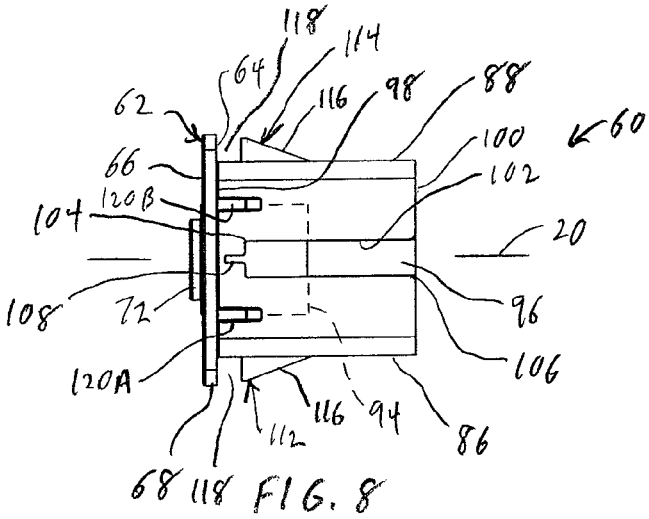
FIG. 8 is a top plan view of the holder.
Figure 9:
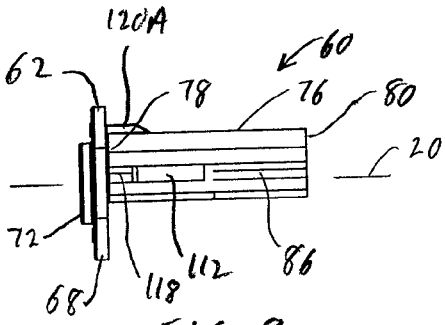
FIG. 9 is a side elevational view of the holder.

Holder 60 also includes a first detent member 112 attached to an outer surface of first side wall 86 and a second detent member 114 attached to an outer surface of second side wall 88. Each detent member 112 and 114 is generally triangular-shaped as shown in FIG. 8. Each detent member 112 and 114 includes an inclined or ramped surface 116 that extends from the outer surface of first side wall 86 or second side wall 88 to an outer end. A gap 118 is located between first detent member 112 and inner surface 64 of end wall 62 and a gap 118 is located between second detent member 114 and inner surface 64 of end wall 62. Ramped ribs 120A and 120B are located at first end 78 of sleeve 76 and are connected to an outer surface of top wall 84 and to inner surface 64 of end wall 62.

Holder 60 also includes one or more spacer ribs 124A-B located in chamber 90 of sleeve 76. Spacer ribs 124A-B extend downwardly from an inner surface of top wall 84 toward bottom wall 82 and are spaced apart from and generally parallel with one another. Spacer ribs 124A-B extend generally parallel to axis 20. Spacer ribs 124A and 124B each include a proximal end coupled to inner surface 64 of end wall 62 and extend to a distal end 126. Spacer ribs 124A and 124B are located on opposite sides of slot 102 and extend generally parallel thereto. Distal ends 126 of spacer ribs 124A and B are spaced apart from inner surface 64 of end wall 62.

Holder 60 also includes one or more gripping members 130A and 130B coupled to inner surface 64 of end wall 62 and located within chamber 90 of sleeve 76. Gripping members 130A-B are located adjacent to and on opposite sides of aperture 70 in end wall 62. Each gripping member 130A and 130B includes a resiliently flexible arm having a proximal end coupled to end wall 62 and an inwardly extending finger at a distal end of the arm. Holder 60 also includes a locating post 132 attached to inner surface 64 of end wall 62 that extends generally perpendicular thereto into chamber 90 of sleeve 76. Locating post 132 is located adjacent aperture 70 between aperture 70 and top wall 84. Holder 60 may be formed from a plastic material.

Lamp 24 is located within chamber 90 of sleeve 76 and is releasably coupled to holder 60 by gripping members 130A-B. Bulb 26 of lamp 24 extends from chamber 90 through aperture 70 in end wall 62. Base 34 of bulb 26 is located adjacent inner surface 64 of end wall 62 and is secured to end wall 62 by gripping members 130A and 130B which releasably engage and grip the bottom surface of base 34. Base 34 of bulb 26 is located adjacent locating post 132. First conductor member 28 of lamp 24 extends from base 34 of bulb 26 generally parallel to axis 20 along and adjacent an inner surface of bottom wall 82 and within groove 96 of bottom wall 82. Second end 38 of first conductor member 28 may be located outwardly beyond second end 80 of sleeve 76. First portion 44 of second conductor member 30 extends generally radially outwardly from base 34 of bulb 26 toward top wall 84. First portion 44 of second conductor member 30 extends adjacent to or in engagement with the distal end of locating post 132 and through notch 108 of slot 102. Second end 48 of first portion 44 is located outwardly from top wall 84 of sleeve 76. Second portion 50 of second conductor member 30 extends from second end 48 of first portion 44 along and generally parallel to slot 102 and is located outwardly from top wall 82 of sleeve 76 when second conductor member 30 is in a normally opened condition.

Cartridge 14 also includes a battery stack 136 including one or more batteries 138. As shown in FIG. 6, battery stack 136 includes two batteries 138. However battery stack 136 may include a single battery 138 or more than two batteries 138 if desired. Each battery 138 of battery stack 136 includes a first end 140 and a second end 142. First end 142 includes a first terminal 144 and second end 142 includes a second terminal 146. First terminal 144 may, for example, be a positive electrical terminal of battery 138 and second terminal 146 may, for example, be a negative terminal of battery 138. Each battery 138 is generally disc-shaped in the form of a coin or a button, such that first terminal 144 and second terminal 146 are generally planar. When battery stack 136 includes a plurality of batteries 138, batteries 138 are stacked one on top of the other with the first terminal 144 of a battery 138 in electrical contact with the second terminal 146 of an adjacent battery 138. Each battery 138 includes a generally circular peripheral edge 148. Battery stack 136 and batteries 138 are located within chamber 90 of sleeve 76 between bottom wall 82 and top wall 84 of sleeve 76 and between first conductor member 28 and second conductor member 30 of lamp 24. First end 140 of a battery 138 in battery stack 136 is located adjacent and in engagement with an inside surface of bottom wall 82 of sleeve 76 and second end 142 of a battery 138 in battery stack 136 is located adjacent and in engagement with an inner surface of top wall 84 of sleeve 76. Bottom wall 82 and top wall 84 of sleeve 76 maintain batteries 138 of battery stack 136 in electrical contact with one another. Peripheral edges 148 of batteries 138 are in engagement with distal ends 126 of spacer ribs 124A and 124B. Spacer ribs 124A and 124B prevent batteries 138 from contacting first portion 44 of second conductor member 30 within chamber 90 of sleeve 76.

First conductor member 28 is in electrical engagement with first terminal 144 at first end 140 of a battery 138 in battery stack 136. Second conductor member 30 of lamp 24 is normally spaced apart from second terminal 146 of a battery 138 in battery stack 136 at second end 142 such that second conductor member 30 is not in electrical engagement with second terminal 146 when second conductor member 30 is in the normally opened condition. Second portion 50 of second conductor member 30 extends over second terminal 146 and second end 142 of battery stack 136 and is spaced apart from second terminal 146 and second end 142 when second conductor member 30 is in the normally opened condition. Peripheral edges 148 of batteries 138 are located adjacent first side wall 86 and second side wall 88 of sleeve 76 to securely position batteries 136 within chamber 90. Batteries 138 are selectively removable from chamber 90 of sleeve 76 through opening 92 for replacement. Lamp 24 is also selectively removable from chamber 90 of sleeve 76 through opening 92 for replacement. Each battery 138 may comprise a lithium battery and may comprise a three volt battery.

Cartridge 14 also includes a housing 160, as shown in FIGS. 11-15, including a first end 162 and a second end 164. Housing 160 includes a generally elliptical-shaped peripheral side wall 166 that extends from first end 162 to second end 164. Housing 160 includes a generally elliptical-shaped end wall 168 attached to side wall 166 at second end 164. Housing 160 includes an opening 170 at first end 162 formed by a peripheral edge 172 of side wall 166. A hollow chamber 174 is located within side wall 166 and is in communication with opening 170. A first slot 176 is located in side wall 166 and extends from an open first end 178 at first end 162 of housing 160 to a closed second end 180. First slot 176 extends generally parallel to axis 20. Side wall 166 also includes a second slot 182 extending generally parallel to axis 20 from an open first end 184 at first end 162 of housing 160 to a closed second end 186. First and second slots 176 and 182 extend generally parallel with one another. Second ends 180 and 186 of slots 176 and 182 are spaced apart from second end 164 of housing 160. First and second slots 176 and 182 are in communication with chamber 174 and open first ends 178 and 184 of slots 176 and 182 are in communication with opening 170. First and second slots 176 and 182 form a cantilevered actuator member 190 therebetween.

Actuator member 190 includes a proximal end 192 located adjacent second ends 180 and 186 of slots 176 and 182 and a distal end 194 located adjacent first end 162 of housing 160. Actuator member 190 includes spaced apart and generally parallel side edges that extend generally parallel to axis 20 and that are formed by first and second slots 176 and 182. Distal end 194 of actuator member 190 includes a generally linear distal edge that extends transversely to axis 20 and that is spaced a short distance inwardly from the plane containing edge 172 of side wall 166. Actuator member 190 extends in a cantilevered manner from proximal end 192 to distal end 194 and is resiliently flexible and bendable. Proximal end 192 of actuator member 190 is integrally formed with side wall 166 and actuator member 190 comprises an integral portion of side wall 166. A generally linear and elongate ridge 204 extends downwardly and inwardly from an interior surface of actuator member 190 into chamber 174. Ridge 204 extends generally parallel to axis 20. Ridge 204 is configured to engage second portion 50 of second conductor member 30.

Side wall 166 of housing 160 includes a first aperture 200 located adjacent first slot 176 and adjacent edge 172 of side wall 166 and a second aperture 202 located adjacent second slot 182 and adjacent edge 172 of side wall 166. First aperture 200 is adapted to receive first detent member 112 and second aperture 202 is adapted to receive second detent member 114 of holder 60 when sleeve 76 of holder 60 is inserted into chamber 174 of housing 60 through opening 170 of housing 160. First and second detent members 112 and 114 thereby couple holder 60 to housing 160. A portion of side wall 166 located between first aperture 200 and edge 172 is located in gap 118 between first detent member 112 and end wall 62 of holder 60. A portion of side wall 166 located adjacent second aperture 202 is located in gap 118 between second detent member 114 and end wall 62 of holder 60. The portions of side wall 166 containing first and second apertures 200 and 202 are sufficiently resiliently flexible such that first and second detent members 112 and 114 can be released from first and second apertures 200 and 202 to allow selective removal of holder 60 from housing 160.

Housing 160 includes a plurality of generally parallel and spaced apart support ribs 210 located in chamber 174. Support ribs 210 extend generally parallel to axis 20 and extend inwardly from an interior surface of side wall 166 toward actuator member 190. Each support rib 210 includes a generally linear top edge 212 configured to engage the outer surface of bottom wall 82 of sleeve 76 to provide support to sleeve 76 and battery stack 136 located within sleeve 76. Housing 160 also includes a retainer rib 216 located in chamber 174 and extending inwardly from an inner surface of side wall 166. Retainer rib 216 may extend across chamber 174 between opposite sides of side wall 166 and may be coupled to end wall 168. Retainer rib 216 includes a generally linear edge 218 that is generally transverse to axis 20 and that extends downwardly from a location adjacent proximal end 192 of actuator member 190. Edge 218 of retainer rib 216 is configured to be located adjacent second end 80 of sleeve 76 and adjacent opening 92 when holder 60 is coupled to housing 160 to retain batteries 138 within chamber 90 of sleeve 76 and prevent batteries 138 from sliding outwardly from chamber 90. The interior surface of end wall 62 of holder 60 is configured to engage edge 172 of side wall 166 of housing 160 when holder 60 is coupled to housing 160. Housing 160 may be formed from a plastic material.

Actuator member 190 is resiliently flexible and bendable such that actuator member 190 may be manually pressed inwardly into chamber 174 and toward batteries 138 in sleeve 76, such that actuator member 190 resiliently bends second conductor member 30 and presses second conductor member 30 into electrical engagement with second terminal 146 of battery 138. Second conductor member 30 is then in a closed position wherein second conductor member 30 completes an electrical circuit between batteries 138 and lamp 24 to thereby illuminate lamp 24. When the manually exerted pressure is released from actuator member 190, actuator member 190 resiliently returns to its original unbiased position and second conductor member 30 resiliently returns to its normally opened condition out of electrical contact with second terminal 146 of batteries 138 to break the electrical circuit and stop illumination of lamp 24.

Figure 16:
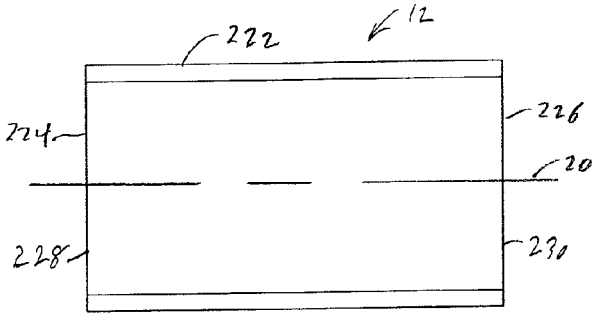
FIG. 16 is a top plan view of the jacket of the flashlight.
Figure 17:
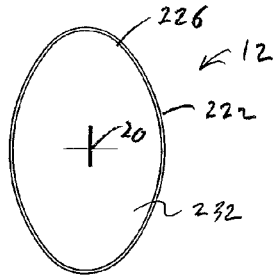
FIG. 17 is an end view of the jacket.

Jacket 12, as shown in FIGS. 16 and 17, includes a side wall 222 extending between a first end 224 and a second end 226. Side wall 222 has a generally elliptical-shaped cross section as shown in FIG. 17 and is located generally concentrically about the axis 20. Side wall 222 forms an opening 228 at first end 224 and an opening 230 at second end 226. Side wall 222 is formed from a plastic material and is resiliently flexible and bendable. Side wall 222 forms a chamber 232 configured to receive cartridge 14 such that side wall 222 extends around side wall 166 of the housing 160 and around edge 68 of end wall 62 of holder 60.

Figure 18:
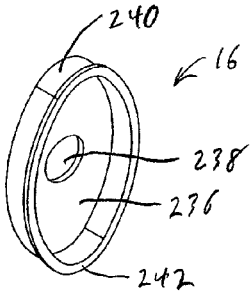
FIG. 18 is a front perspective view of the front end cap of the flashlight.
Figure 19:
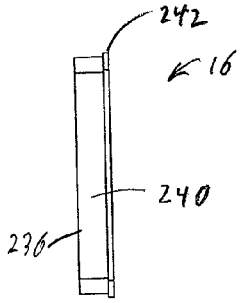
FIG. 19 is a side view of the front end cap.
Figure 20:
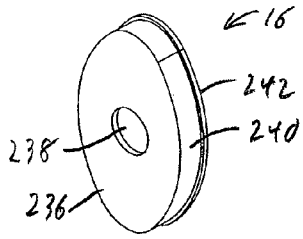
FIG. 20 is a rear perspective view of the front end cap.

Front cap 16 as shown in FIGS. 18-20 includes a generally planar and elliptical-shaped wall 236 having a central generally circular aperture 238. A side wall 240 extends around the perimeter of wall 236 and projects outwardly generally perpendicular to wall 236. A peripheral lip 242 extends along the distal edge of side wall 240. Lip 242 extends outwardly from side wall 240 generally parallel to wall 236. Wall 236 and side wall 240 are inserted into opening 228 of jacket 12 such that lip 242 engages first end 224 of side wall 222 of jacket 12. Wall 236, side wall 240 and lip 242 are each formed in the general shape of an ellipse.

Figure 21:
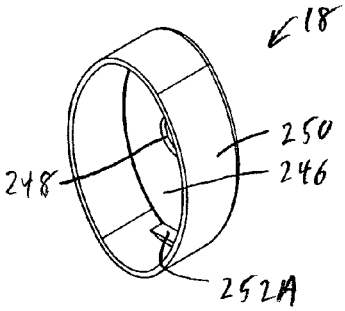
FIG. 21 is a perspective view of the rear end cap.
Figure 22:
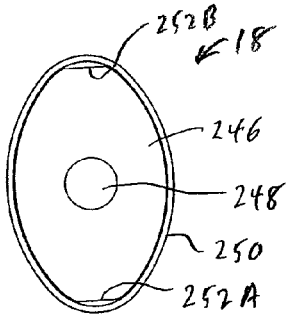
FIG. 22 is a front elevational view of the rear end cap.
Figure 23:
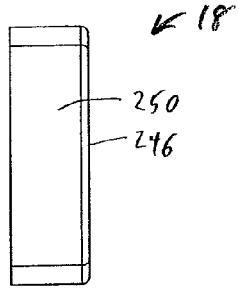
FIG. 23 is a side elevational view of the rear end cap.
Figure 24:
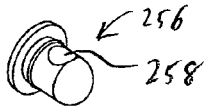
FIG. 24 is a perspective view of the swivel stud of the flashlight.
Figure 25:
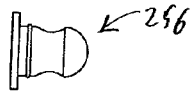
FIG. 25 is a side elevational view of the swivel stud.

Rear end cap 18 as shown in FIGS. 21-23 includes a generally planar and generally elliptical shaped wall 246. If desired, wall 246 may include a central generally circular aperture 248. A generally elliptical-shaped side wall 250 extends around the perimeter of wall 246 and extends outward and generally perpendicular to wall 246. Stop members 252A and 252B are located adjacent end wall 246 on opposite sides of aperture 248 along a major axis of wall 246 and adjacent side wall 250. Second end 226 of side wall 222 of jacket 12 is configured to be inserted within side wall 250 of rear end cap 18 with second end 226 engaging stop members 252A and 252B. A stud 256, as shown in FIGS. 24 and 25, having a transverse aperture 258 may extend through aperture 248 in wall 246 of rear end cap 18. Stud 256 may be rotatable with respect to wall 246 about axis 20. Stud 256 is configured to receive an attachment member such as a key ring, key chain or lanyard.

Cartridge 14 is located within chamber 232 of jacket 12 with front end cap 16 coupled to first end 224 of side wall 222 and rear end cap 18 coupled to second end 226 of side wall 222. Bulb 26 of lamp 24 extends outwardly through aperture 238 in front end cap 16. If desired rear end cap 18 may be removably coupled to jacket 12 such that cartridge 14 is selectively movable from jacket 12.

In operation, a force may be manually applied to an outer surface portion of side wall 222 of jacket 12 that is overlying actuator member 190 of housing 160. Side wall 222 of jacket 12 is manually pressed inwardly thereby resiliently deflecting and bending side wall 222. As side wall 222 is deflected inwardly, side wall 222 presses upon the outer surface of actuator member 190 to resiliently bend and deflect actuator member 190 toward top wall 84 of sleeve 76 and toward second end 142 of battery stack 136. Actuator member 190 thereby resiliently bends and deflects second conductor member 30 toward second end 142 of battery stack 136 such that second portion 50 of second conductor member 30 comes into electrical engagement with second terminal 146 of battery 138 in battery stack 136 whereby second conductor member 30 is in the closed position and whereby an electrical circuit is completed between batteries 138 of battery stack 136 and bulb 26 of lamp 24 to actuate and illuminate bulb 26. When the manually applied external force is released from side wall 222, side wall 222 resiliently returns to its original unbiased position, actuator member 190 resiliently returns to its original unbiased position, and second conductor member 30 returns to its original normally opened condition wherein second conductor member 30 is spaced apart from second terminal 146 of battery stack 136 and such that the electrical circuit with bulb 26 of lamp 24 is broken and bulb 26 is not illuminated.

The invention claimed is:

1. A flashlight comprising:

a holder including a first end, a second end, an end wall and a sleeve, the end wall including an aperture, the sleeve extending between a first end and a second end and including a bottom wall, a top wall spaced apart from the bottom wall and a chamber located between the bottom wall and the top wall, the first end of the sleeve being coupled to the end wall, the second end of the sleeve including an opening in communication with the chamber, the top wall including a slot in communication with the chamber;

a lamp including a bulb, a first conductor member coupled to the bulb, and an elongate resiliently flexible second conductor member coupled to the bulb, the second conductor member being spaced apart from the first conductor member, the bulb being located in the aperture of the end wall of the holder, the first conductor member located adjacent an interior surface of the bottom wall of the sleeve, and the second conductor member extending from the chamber of the sleeve into the slot in the top wall of the sleeve;

one or more batteries located in the chamber of the holder, the one or more batteries having a first end located adjacent the interior surface of the bottom wall of the sleeve, the first end of the one or more batteries including a first terminal, the first conductor member of the lamp being in electrical contact with the first terminal of the one or more batteries, the one or more batteries including a second end adjacent an interior surface of the top wall of the sleeve, the second end of the one or more batteries including a second terminal, the second conductor member of the lamp normally being spaced outwardly from the second terminal of the one or more batteries in an opened condition such that the second conductor member of the lamp is not in electrical contact with the second terminal of the one or more batteries; and a housing having a first end and a second end and a peripheral side wall extending between the first end and second end of the housing, the side wall forming a chamber and an opening at the first end of the housing in communication with the chamber of the housing, the side wall including a resiliently flexible actuator member, the sleeve of the holder extending into the chamber of the housing through the opening in the first end of the housing such that the second conductor member of the lamp is associated with the actuator member of the housing, the actuator member being selectively inwardly bendable such that the actuator member resiliently bends the second conductor member of the lamp to a closed condition wherein the second conductor member is in electrical contact with the second terminal of the one or more batteries to illuminate the lamp.

2. The flashlight of claim 1 including a flexible jacket forming a chamber, the housing located within the chamber of the flexible jacket, the flexible jacket configured to be manually pressed inwardly to thereby press the actuator of the housing inwardly and thereby bend the second conductor member of the lamp into electrical contact with the second terminal of the one or more batteries to illuminate the lamp.

3. The flashlight of claim 1 wherein the first conductor member of the bulb includes a first end and a second end, the first end located adjacent the bulb, the first conductor member extending generally linearly from the first end to the second end.

4. The flashlight of claim 3 wherein the second conductor member includes a first portion and a second portion, the first portion having a first end and a second end, the first end of the first portion located adjacent the bulb, the first portion extending through the slot in the top wall of the housing, the second portion extending from a first end coupled to the second end of the first portion to a second end of the second portion, the second portion extending along the slot in the top wall of the sleeve.

5. The flashlight of claim 4 including one or more ribs located in the chamber of the sleeve, the ribs being located between the end wall and the one or more batteries, the ribs configured to engage the one or more batteries and prevent the one or more batteries from contacting the first portion of the second conductor member of the lamp.

6. The flashlight of claim 1 wherein the first conductor member comprises a first wire and the second conductor member comprises a second wire, the first wire and the second wire being generally located in the same plane with respect to one another.

7. The flashlight of claim 1 wherein the slot of the top wall of the sleeve includes a first end and a second end, the second end of the slot comprising an open end in communication with the opening in the second end of the sleeve, the first end of the slot comprising a closed end, the closed end of the slot including a notch, the second conductor member of the lamp extending through the notch.

8. The flashlight of claim 1 wherein the holder includes one or more gripping members attached to an interior surface of the end wall, each gripping member configured to grip the bulb of the lamp to releasably secure the bulb to the end wall.

9. The flashlight of claim 1 wherein each battery of the one or more batteries comprises a generally disc-shaped battery.

10. The flashlight of claim 1 wherein the sleeve of the holder includes a first side wall extending between the bottom wall and the top wall and a second side wall extending between the bottom wall and the top wall of the sleeve, the first side wall and the second side wall being spaced apart from one another with the one or more batteries located between the first side wall and the second side wall.

11. The flashlight of claim 10 wherein the holder includes a first detent member attached to the first side wall and a second detent member attached to the second side wall of the sleeve, and the side wall of the housing includes a first aperture and a second aperture, the first aperture of the housing configured to receive the first detent member and the second aperture of the housing configured to receive the second detent member to thereby secure the holder to the housing.

12. The flashlight of claim 11 wherein the holder includes a first gap located between the first detent member and the end wall and a second gap located between the second detent member and the end wall, the first gap and the second gap each configured to receive the side wall of the housing.

13. The flashlight of claim 1 wherein the side wall of the housing includes a first slot and a spaced apart second slot extending from the first end of the housing toward the second end of the housing, the actuator member including a first side edge formed by the first slot and a second side edge formed by the second slot.

14. The flashlight of claim 1 wherein the actuator member includes a proximal end and a distal end, the actuator member extending outwardly from the proximal end to the distal end in the cantilevered manner.

15. The flashlight of claim 14 wherein the proximal end of the actuator member is integrally formed as a portion of the side wall of the housing.

16. The flashlight of claim 1 wherein the actuator member is integrally formed as a portion of the side wall of the housing.

17. The flashlight of claim 1 wherein the housing includes one or more support ribs located in the chamber of the housing and extending inwardly from an interior surface of the side wall of the housing, the support ribs configured to support the bottom wall of the holder.

18. The flashlight of claim 1 wherein the housing includes a retainer rib located in the chamber of the housing that extends inwardly from an interior surface of the side wall of the housing, the retainer rib located adjacent the opening in the second end of the sleeve of the holder such that the retainer rib prevents the one or more batteries from sliding out of the chamber of the sleeve through the opening in the second end of the sleeve.

19. The flashlight of claim 1 wherein the actuator member includes a generally elongate ridge extending inwardly into the chamber of the housing from an interior surface of the actuator member, the ridge configured to engage the second conductor member of the lamp.

20. A flashlight comprising:

a holder including a first end, a second end, an end wall and a sleeve, the end wall including an aperture, the sleeve extending between a first end and a second end and including a bottom wall, a top wall spaced apart from the bottom wall and a chamber located between the bottom wall and the top wall, the first end of the sleeve being coupled to the end wall, the second end of the sleeve including an opening in communication with the chamber, the top wall including a slot in communication with the chamber;

a lamp including a bulb, a first conductor member coupled to the bulb, and a second member coupled to the bulb, the first conductor member comprising an elongate wire, the second conductor member comprising an elongate resiliently flexible wire, the second conductor member being spaced apart from the first conductor member, the bulb being located in the aperture of the end wall of the holder, the first conductor member located adjacent an interior surface of the bottom wall of the sleeve, and the second conductor member extending from the chamber of the sleeve into the slot in the top wall of the sleeve;

one or more batteries located in the chamber of the holder between the first conductor member and the second conductor member, the one or more batteries having a first end located adjacent the interior surface of the bottom wall of the sleeve, the first end of the one or more batteries including a first terminal, the first conductor member of the lamp being in electrical contact with the first terminal of the one or more batteries, the one or more batteries including a second end adjacent an interior surface of the top wall of the sleeve, the second end of the one or more batteries including a second terminal, the second conductor member of the lamp normally being spaced outwardly from the second terminal of the one or more batteries in an open condition such that the second conductor member of the lamp is not in electrical contact with the second terminal of the one or more batteries; and a housing having a first end and a second end and a peripheral side wall extending between the first end and second end of the housing, the side wall forming a chamber and an opening at the first end of the housing in communication with the chamber of the housing, the side wall including a resiliently flexible actuator member, the sleeve of the holder extending into the chamber of the housing through the opening in the first end of the housing such that the second conductor member of the lamp is associated with the actuator member of the housing, the actuator member being selectively inwardly bendable such that the actuator member resiliently bends the second conductor member of the lamp to a closed condition wherein the second conductor member is in electrical contact with the second terminal of the one or more batteries to illuminate the lamp.

* * * * *